US006979239B1

(12) United States Patent
Richard et al.

(10) Patent No.: US 6,979,239 B1
(45) Date of Patent: Dec. 27, 2005

(54) PLATING OF BRAZED RF CONNECTORS FOR T/R MODULES

(75) Inventors: Patrick K. Richard, Baltimore, MD (US); Edward L. Rich, III, Arnold, MD (US); Kevin L. Ebersole, Catonsville, MD (US); Angela J. Martin, Davidsonville, MD (US); Tapan K. Gupta, Ellicott City, MD (US); David W. Strack, Eldersburg, MD (US); John S. Fisher, III, Ellicott City, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/879,042

(22) Filed: Jun. 30, 2004

(51) Int. Cl.[7] ..... H01R 13/00
(52) U.S. Cl. ..... 439/886
(58) Field of Search ..... 439/886, 607, 439/608, 609, 519; 29/883; 205/123, 128, 205/129, 145, 82; 114/67

(56) References Cited

U.S. PATENT DOCUMENTS 3,683,331 A * 8/1972 Overholser ..... 439/519
4,710,138 A * 12/1987 Bradley et al. ..... 439/581
4,924,236 A * 5/1990 Schuss et al. ..... 343/700 MS
5,015,197 A * 5/1991 Redmond et al. ..... 439/329
5,188,546 A * 2/1993 Ballard et al. ..... 439/885
5,242,570 A * 9/1993 Roodnat ..... 205/128
5,722,861 A * 3/1998 Wetter ..... 439/701
6,114,986 A 9/2000 Cassen et al.
6,368,167 B1 * 4/2002 Ma et al. ..... 439/886
6,454,916 B1 * 9/2002 Wang et al. ..... 204/224 R
6,876,530 B2 * 4/2005 Parker et al. ..... 361/58

* cited by examiner

*Primary Examiner*—Alexander Gilman
(74) *Attorney, Agent, or Firm*—Birch, Stewart, Kolasch & Birch, LLP

(57) ABSTRACT

Slots or apertures are formed in the connector shroud of a T/R module in a plane perpendicular to the axis of the connector so as to allow plating solution to flow freely through the entire inner portion of the connector, particularly the rear portion, during fabrication of the T/R module. The slots are formed prior to the shroud being brazed on to the module substrate. By allowing plating solution to flow through the connector, the interior of the connector can be more thoroughly plated, thereby improving the yield of the assembly while reducing cost.

15 Claims, 1 Drawing Sheet

PLATING OF BRAZED RF CONNECTORS FOR T/R MODULES

BACKGROUND OF THE INVENTION

1. Field of the Invention

This invention relates generally to the fabrication of transmit/receive (T/R) modules used in connection with the aperture of an active electronically scanned array, and more particularly to the plating of RF connectors brazed onto the front side of high temperature co-fired ceramic (HTCC) substrate of a T/R module package.

2. Description of the Prior Art

The process of brazing RF connectors onto the side of an HTCC package involves re-flowing the high temperature alloy of copper and silver (Cusil) to provide a robust mechanical attachment of the center pin and shroud of the RF connector to a substrate member of a T/R module shown, for example, in U.S. Pat. No. 6,114,986, entitled "Dual channel Transmit/Receive Module For An Active Aperture Of A Radar System". The materials involved in this operation, Kovar for the center pin and shroud and Cusil brazing material, are prone to corrosion and therefore require gold plating to prevent corrosion in any non-hermetic environment. Plating of this part involves first nickel plating and then gold plating. Any non-plated area on the center pin area can result in corrosion of the center pin and loss of the RF signal, resulting in a catastrophic failure of the entire T/R module package.

The present state of the art for fabrication/assembly of a connector onto a T/R module package typically involves brazing the center pin and shroud of the connector as stated above. The shroud is currently an elongated solid structure including a plurality of generally cylindrical apertures through which the center pins project and which is required to connect the ground signal of the mating structure, i.e., the connector. During the plating process, the module package is placed in plating baths of nickel followed by gold. For proper plating, i.e., complete plating to occur, the solution must flow throughout the interior of the connector shroud. However, this does not often occur due to the inherent physical features of the inner walls of the connector shroud. It has been found that due to the lack of good plating solution flow throughout the interior of the RF connector, a relatively large number of packages have been rejected because of unplated areas around the connector center pins. The pins do not have proper plating, for example, where the pin is brazed to the ceramic package. This plating deficiency occurs as a result of a lack of flow of the plating solution within the connector.

Since plating is performed at the end of the package fabrication process, a rejection of the package results in a loss at the most expensive point in the process of a finished product. Thus an unreasonable number of failures in a production system using this type of RF interconnect can result in a relatively large increase in the overall cost of acceptable or "good" T/R module packages.

SUMMARY

Accordingly, it is the primary object of the present invention to provide an improvement in the fabrication of a T/R module.

It is another object of the present invention to improve the plating flow of plating material throughout the interior of an RF connector for a T/R module package during fabrication of a T/R module.

It is a further object of the present invention to provide a plating process wherein the plating fluid is made to more easily contact and flow around all of the interior metallized surfaces of an RF connector shroud.

These and other objects are achieved by initially providing openings such as slots or holes in the shroud of an RF connector of a T/R module package in the region of the connector pins prior to being brazed to a ceramic substrate so as to subsequently allow plating solution to flow freely throughout the interior of the RF connector and particularly around the connector pins. The slots or holes are large enough to allow proper plating of the interior of the connector but small enough to prevent any radiation through the connector to the exterior of the T/R module package.

Further scope of applicability of the present invention will become apparent from the detailed description given hereinafter. It should be understood, however, that the detailed description and specific example, while illustrating the preferred embodiment of the invention, it is given by way of illustration only, since various changes and modifications coming within the spirit and scope of the invention will become apparent to those skilled in the art from this detailed description.

DESCRIPTION OF THE DRAWINGS

The present invention will become more fully understood from the detailed description provided hereinafter in the accompanying drawings which are given by way of illustration only, and thus are not meant to be limitative of the present invention, and wherein.

DETAILED DESCRIPTION OF THE INVENTION

Figure 4:
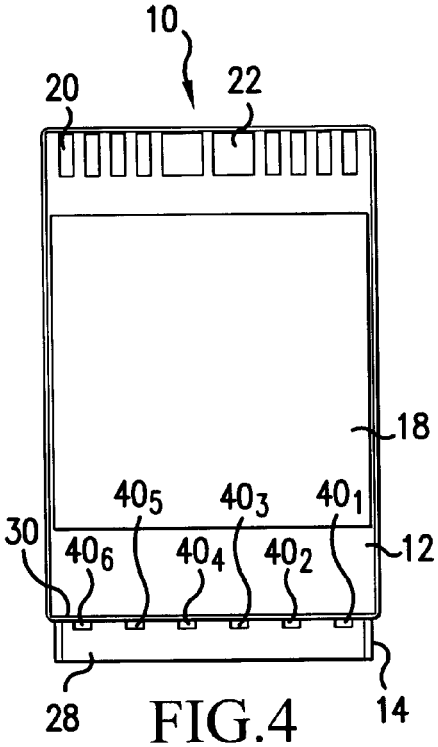
FIG. 4 is a bottom plan view of the T/R module shown in FIG. 1.

Referring now collectively to the drawings and more particularly to FIGS. 1–4, shown is a microwave transmit/receive (T/R) module 10 utilized in connection with an active electronically scanned array. The details of such a T/R module is shown and described in the above-referenced U.S. Pat. No. 6,114,986. What is common between the T/R module 10 of the subject invention and that shown and described in U.S. Pat. No. 6,114,986, is the use of a dielectric substrate 12 onto which an RF connector assembly 14 is brazed. The substrate 12 constitutes a multi-level configuration of high temperature co-fired ceramic (HTCC) in which active and passive circuit elements, not shown, are located to provide routing of RF signals between respective antenna elements of the array and the circuit elements as well applying DC power supply voltages. To protect the interior of the substrate 12, a cover plate 16 is secured to the top of the substrate. A heat sink plate 18 is also provided on the bottom of the substrate 12 as shown in FIG. 4 for transferring heat generated by the active components, located interiorally of the substrate into an external heat sink, also not shown. Reference numerals 20 and 22 shown in FIG. 4 at the rear end of the module 10 denote metal tabs which are used for coupling DC signals to the various active components within the substrate 12.

Figure 5:
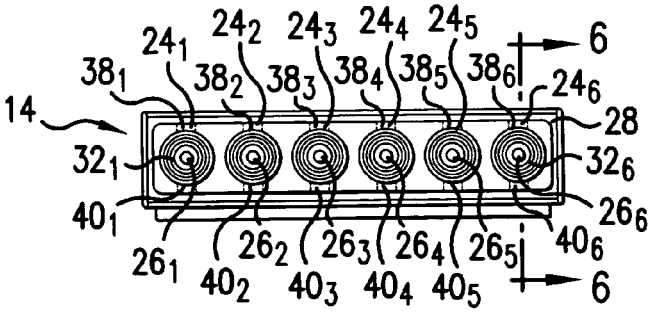
FIG. 5 is a front planar view of the RF connector shown in FIG. 1.

The present invention is directed to the connector assembly 14 which is shown in FIG. 5 comprising a blind mate press-on RF connector assembly including six identical RF coaxial connector elements $\mathbf{24}_1 \ldots \mathbf{24}_6$ arranged linearly within and across a metal shroud 28.

Figure 1:
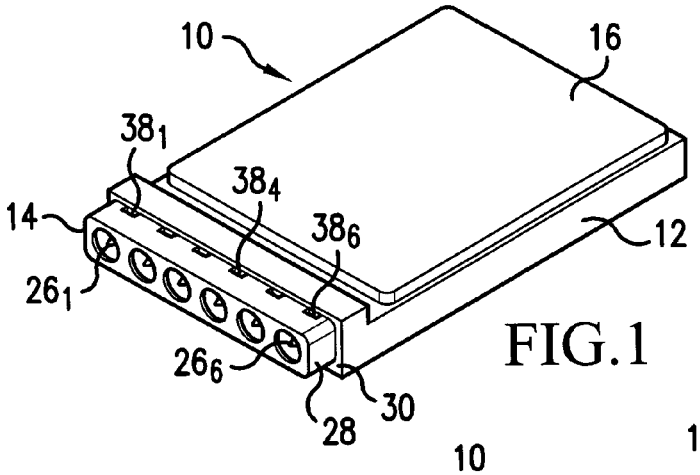
FIG. 1 is a perspective view of a transmit/receive (T/R) module including a connector shroud fabricated in accordance with the subject invention.
Figure 2:
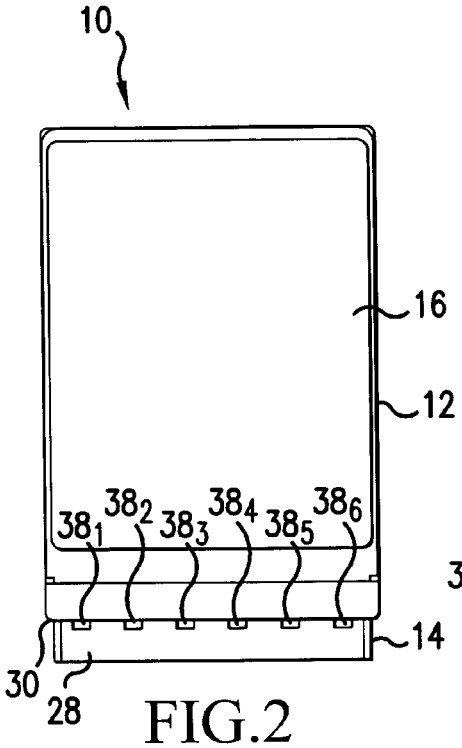
FIG. 2 is a top plan view of the T/R module shown in FIG. 1.
Figure 3:
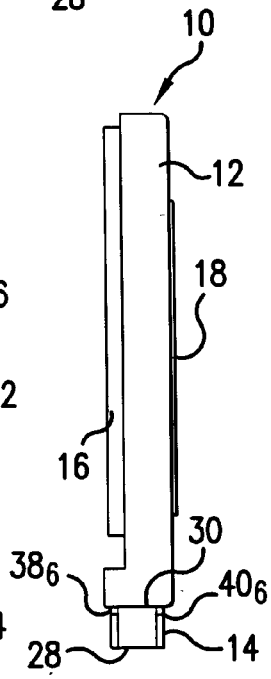
FIG. 3 is a side plan view of the T/R module shown in FIG. 1.
Figure 6:
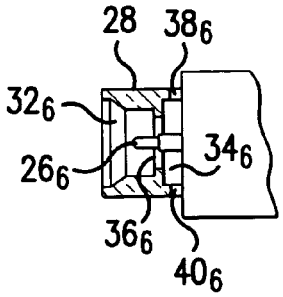
FIG. 6 is a partial longitudinal cross-sectional view of the connector shown in FIG. 5 taken along the lines 6—6 thereof.

As noted above and referring now to FIGS. 5 and 6, fabrication of the T/R module 10 involves brazing center pins $\mathbf{26}_1 \ldots \mathbf{26}_6$ and a prefabricated shroud 28 to the front side 30 of a ceramic HTCC substrate 12 as shown, for example, in FIG. 1, and involves the application of a copper/silver alloy to provide a mechanical attachment. As noted, Kovar is used for attaching the center pins $\mathbf{26}_1$ $\mathbf{26}_6$ while Cusil is used for brazing the shroud to the substrate surface 30.

The assembled elements are next placed in electrolytic plating baths, first of nickel and then of gold. It can be seen by reference to FIG. 6 that the structural features of the interior of the six connectors $\mathbf{24}_1 \ldots \mathbf{24}_6$ in the shroud 28 each include, for example as shown with respect to connector 246, a flared front opening $\mathbf{32}_6$, a rear section $\mathbf{34}_6$ separated by an opening $\mathbf{36}_6$ through which the center pin $\mathbf{26}_6$ passes. It can be readily seen that proper plating flow throughout the interior of the RF shroud 28 and the connector pins 26 can be less than desired, particularly as it pertains to the flow of plating material to the surfaces within the rear section $\mathbf{34}_6$ around the center pin 26.

Accordingly, this invention is directed to the solution of the plating problem noted above by fabricating generally rectangular slots or holes in the shroud 28 above and below the location of each RF connector $\mathbf{24}_1 \ldots \mathbf{24}_6$. This is shown in FIGS. 2–5 by upper and lower slots $\mathbf{38}_1 \ldots \mathbf{38}_6$ and $\mathbf{40}_1 \ldots \mathbf{40}_6$. The pairs of upper and lower slots $\mathbf{38}_1$, $\mathbf{40}_1 \ldots \mathbf{38}_6$, $\mathbf{40}_6$ allow for plating solution to flow more freely throughout the interior of the RF connector shroud 28 and particularly into the interior spaces $\mathbf{34}_1 \ldots \mathbf{34}_6$. The holes or slots $\mathbf{38}_1 \ldots \mathbf{38}_6$ and $\mathbf{40}_1 \ldots \mathbf{40}_6$, moreover, are sized to prevent RF leakage, but large enough so as not to trap air bubbles inside the shroud 28.

Since the functions of an RF connector in a T/R module are to provide a low loss connection between two different structures and to provide RF isolation, that is to prevent the RF signal from leaking out, the first of these functions is not affected by the slots as the center conductor is not changed and where the slots are made to be below waveguide cut-off. The second function of the connector is potentially affected due to the holes placed in the shroud but since they are below waveguide cut-off there is relatively no evenescient mode radiation.

The slots or holes $\mathbf{38}_1 \ldots \mathbf{38}_6$ and $\mathbf{40}_1 \ldots \mathbf{40}_6$ are fabricated by machining operation which is performed prior to brazing the connector shroud 28 onto the ceramic substrate 12. It should be noted that the added cost of the additional machining operation is practically negligible when compared to the loss of the entire package, particularly where T/R modules in acceptable condition numbering in the thousands must be produced and delivered.

Thus what has been shown and described is a connector shroud brazed on the forward surface of a dielectric substrate which permits plating fluid in an electrolytic plating process to move readily to contact and flow by all the interior metallized surfaces including the connector pins, as opposed to prior art connector shrouds which tend to inhibit fluid from reaching all the surfaces due to the closed nature of the shroud itself.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of plating the surfaces of an RF connector assembly attached to the substrate of a transmit/receive module utilized in connection with an active aperture of a radar system and including at least one connector pin located in an aperture of a metal shroud so as to form a coaxial connector, comprising the steps of:

forming at least one opening through the shroud in the region of the connector pin so as to allow plating material to flow freely therethrough, and thereafter plating the RF connector assembly by flowing plating solution throughout the interior of the shroud and around the connector pin by way of an aperture and said opening, and wherein the size of the opening permits proper plating of the connector while preventing radiation from passing through openings to the exterior of the connector assembly.

2. The method of plating according to claim 1 wherein said at least one opening is formed in the shroud prior to attachment to the substrate.

3. The method of plating according to claim 1 wherein the substrate comprises a ceramic substrate and the shroud is secured to a side surface of the substrate by a brazing step prior to the step of plating.

4. The method of plating according to claim 3 wherein said brazing step includes brazing with copper and silver and precedes the plating step.

5. The method of plating according to claim 1 wherein said plating step includes electrolytic plating first with a solution of nickel and then with a solution of gold.

6. The method of plating according to claim 5 wherein said at least one opening comprises a pair of openings, one of said openings being on one side of the center pin and the other of said openings being on the other side of the center pin.

7. The method of plating according to claim 5 wherein said pair of openings comprises a pair of slots or holes above and below the center pin.

8. The method of plating according to claim 7 wherein the connector assembly includes a plurality of connector pins and respective apertures in the shroud.

9. The method of plating according to claim 8 wherein the plurality of connector pins and respective apertures are selectively positioned in the shroud.

10. The method of plating according to claim 9 wherein said connector pins and apertures comprise a predetermined arrangement thereof.

11. A plated RF connector assembly for a transmit/receive module utilized in connection with the aperture of an active electronic array, comprising:

a plurality of connector pins and a shroud including respective apertures for the connector pins attached to one end surface of a substrate of the transmit/receive module, said shroud including at least one opening therethrough so that plating material flows through the interior of the shroud during electrolytic plating of the connector assembly and wherein said at least one opening is perpendicular to a mating direction of the connector assembly.

12. The RF connector assembly according to claim 11 wherein said at least one opening is sized so as to permit free flow of plating material therethrough while preventing the passage of radiation from the interior of the shroud to the free space outside of the shroud.

13. The RF connector assembly according to claim 12 wherein said at least one opening comprises a plurality of openings in said shroud.

14. The RF connector assembly according to claim 13 wherein said plurality of openings comprises respective pairs of slots located above and below the connector pins.

15. The RF connector assembly according to claim 14 wherein the slots are fabricated in the shroud prior to being attached to the substrate.

* * * * *